US011059055B2

(12) United States Patent
Auffinger et al.

(10) Patent No.: US 11,059,055 B2
(45) Date of Patent: Jul. 13, 2021

(54) PACKAGING TO FACILITATE HEAT TRANSFER FOR MATERIALS

(71) Applicant: The Boeing Company, Chicago, IL (US)

(72) Inventors: Sean Auffinger, Cambridge, MA (US); Caitlin E. Auffinger, Ladson, SC (US); Thomas G. Lawton, Ladson, SC (US); Chunxing She, Summervile, SC (US); Katherine L. Frank, Charleston, SC (US); Conor J. Van Camp, North Charleston, SC (US); Kevin D. Gordon, Summerville, SC (US)

(73) Assignee: THE BOEING COMPANY, Chicago, IL (US)

( * ) Notice: Subject to any disclaimer, the term of this patent is extended or adjusted under 35 U.S.C. 154(b) by 0 days.

(21) Appl. No.: 16/551,531

(22) Filed: Aug. 26, 2019

(65) Prior Publication Data

US 2021/0060584 A1 Mar. 4, 2021

(51) Int. Cl.

| | |
|---|---|
| ***B05B 1/00*** | (2006.01) |
| ***B65D 83/00*** | (2006.01) |
| ***B05C 17/00*** | (2006.01) |
| ***B05B 1/24*** | (2006.01) |
| ***B05C 17/005*** | (2006.01) |

(52) U.S. Cl.

CPC ..... *B05B 1/24* (2013.01); *B05C 17/00523* (2013.01); *B05C 17/00593* (2013.01); *B65D 83/0022* (2013.01)

(58) Field of Classification Search

CPC ..... B05B 1/24; B05B 1/06; B05C 17/00523; B05C 17/00593; B05C 17/00526; B05C 17/00533; B05C 17/00543; B65D 83/0022

USPC ..... 222/146.1–146.2, 146.4, 146.6, 386, 222/389–392

See application file for complete search history.

(56) References Cited

U.S. PATENT DOCUMENTS 1,285,086 A * 11/1918 Falkinburg ..... B67D 3/0009 222/131
1,676,224 A * 7/1928 Spiliotakaras ..... A47J 19/00 222/131
3,364,577 A * 1/1968 Oakleaf ..... A61C 13/0028 433/32

(Continued)

OTHER PUBLICATIONS

PRC and Pro-Seal Aerospace Sealants Application Guide, PRC-DeSoto International, a PPG Industries Company, 4 pages [online], [retrieved on Oct. 1, 2019], Retrieved from the internet: <URL: http://www.ppgaerospace.com/getmedia/d53f5c57-4556-4637-9509-0c63a85fd574/Aerospace-Sealants-Application-Guide.pdf.aspx>.

(Continued)

*Primary Examiner* — Paul R Durand
*Assistant Examiner* — Andrew P Bainbridge
(74) *Attorney, Agent, or Firm* — Haynes and Boone, LLP

(57) ABSTRACT

Systems and methods for a container for decreasing the thawing time for a liquid, gel or other fluid material is described herein. The systems can include a container with a body. The body can include a cavity with a dispensing nozzle and a plunger disposed within the cavity. The body can further include one or more channels separate from the cavity. The channel(s) increases the rate of heat transfer associated with the container and, thus, increases the cooling or heating rate of the material within the container.

20 Claims, 7 Drawing Sheets

(56) References Cited

U.S. PATENT DOCUMENTS 3,831,815 A * 8/1974 Glasgow ..... A61C 13/0028 433/32
3,945,534 A * 3/1976 Ady ..... A47J 47/01 222/105
3,970,395 A * 7/1976 Flint ..... B05C 17/001 401/1
4,008,832 A * 2/1977 Rodth ..... B67D 1/0861 222/129.1
4,065,034 A * 12/1977 Callan ..... B05C 3/132 222/146.5
4,632,278 A * 12/1986 Donaldson ..... H02G 1/14 219/230
4,884,721 A * 12/1989 Kirchler ..... A47J 43/12 222/146.6
4,899,910 A * 2/1990 Tabei ..... E04G 23/02 222/54
5,150,820 A * 9/1992 McGill ..... A23G 3/28 222/146.6
5,501,371 A * 3/1996 Schwartz-Feldman ..... A61C 9/0026 222/136
5,881,924 A * 3/1999 Bokros ..... B05C 17/00546 222/146.5
5,932,129 A * 8/1999 Hyatt ..... A61F 7/007 219/528
6,209,344 B1 * 4/2001 Mahajan ..... F25D 31/007 62/457.3
6,325,244 B2 * 12/2001 Vincent ..... A23G 9/228 222/1
7,030,339 B2 * 4/2006 Nagase ..... C22C 38/16 219/229
7,086,861 B2 * 8/2006 Pitz ..... A61C 5/62 401/1
8,309,877 B2 * 11/2012 Teraoka ..... B23K 3/03 219/85.2
8,631,973 B2 * 1/2014 Grundler ..... A61C 5/62 222/137
9,027,796 B1 * 5/2015 Leitch ..... B05C 17/0052 222/192
10,792,698 B2 * 10/2020 Warren ..... H05B 3/40
2006/0081650 A1 * 4/2006 Axinte ..... B05C 17/00526 222/146.2
2010/0084431 A1 * 4/2010 Miller ..... B65D 35/24 222/146.2
2019/0366362 A1 * 12/2019 Binek ..... B05B 7/205

OTHER PUBLICATIONS

How Do Defrosting Trays Work?,Reference.com, 2 pages, [online], [retrieved Oct. 1, 2019], Retrieved from the Internet: <https://www.reference.com/home-garden/defrosting-trays-work-4d36161d78e19670>.

Thermal Cool Heat Sink Capabilities & manufacturing Processes, Thermo Cool Corporation, 2 pages [online] [retrieved on Oct. 1, 2019], Retrieved from the internet: <https://thermocoolcorp.com/?gclid=EAIaIQobChMI18_Wr9XZ4QIVD8ZkCh2iPApwEAMYAyAAEgK-o_D_BwE>.

* cited by examiner

PACKAGING TO FACILITATE HEAT TRANSFER FOR MATERIALS

TECHNICAL FIELD

The disclosure relates generally to materials packaging and, more specifically, to materials packaging to facilitate heat transfer for materials.

BACKGROUND

Many industries use materials stored under frozen conditions, wherein it would be useful to provide quicker thaw times. Examples of such industries include the medical industry wherein it is important to quickly thaw frozen liquid, gel or other frozen fluid materials quickly for use in a time-sensitive manner. Other industries such as the construction industry, vehicle industry, aeronautics industry and many other industries use liquids, gels and other fluid materials that are frozen, and quick thawing of such fluids would be beneficial. For example, aerospace vehicles such as airplanes and other products can use a variety of sealants, adhesives, and other materials during assembly. Such materials can be temperature sensitive. Higher temperatures can accelerate the rate of curing of such sealants, adhesives, and other materials. As such, the materials are typically stored and transported within containers at low temperatures.

Such handling requires the materials to be thawed before application. The time to thaw such materials affects throughput of aircraft assembly and fabrication. For example, it may take up to 45 minutes or an hour to thaw at room temperature, up to 10 minutes or more using forced air at room temperature, and up to 7 minutes or more in a 120° F. water bath. Currently, thawing of such materials is accomplished by submerging the container in a water bath or waiting for ambient air to warm the material to a proper temperature.

SUMMARY

Systems and methods are disclosed for a materials container. In an example, an apparatus is disclosed. The apparatus includes-a container body that includes a cavity disposed within the container body and configured to receive a material, a nozzle fluidically connected to the cavity and configured to dispense the material from the cavity, and a channel disposed adjacent to the cavity and within a portion of the container body separating the channel and the cavity. The channel is configured to receive a second material to facilitate heat transfer between the first and second material.

A method of using the apparatus is also disclosed. The method can include disposing the material within the cavity, cooling the material, and thawing the material before dispensing the material through the nozzle.

In an example, a method of decreasing thawing time of a frozen fluid material in a container body is disclosed. The method includes coupling a heat sink element to the container body. The container body includes a cavity holding the frozen fluid material. The container body also includes a nozzle fluidically connected to the cavity and configured to dispense a thawed version of the frozen fluid material from the cavity. The container body also includes a channel disposed adjacent to the cavity and within a portion of the container separating the channel and the cavity. The channel is configured to receive a second material to facilitate heat transfer between the frozen fluid material and the second material. The method further includes thawing the frozen fluid material to obtain thawed material. The method further includes dispensing the thawed material through the nozzle.

In an example, a method is disclosed. The method includes disposing a first material within a cavity of a container body. The method further includes cooling the first material to obtained cooled material. The method further includes disposing a second material within a channel of the container body, where the channel is adjacent to the cavity and within a portion of the container body separating the channel and the cavity. The method further includes transferring heat between the cooled material and the second material to thaw the cooled material to obtain thawed material. The method further includes dispensing the thawed material through a nozzle of the container body.

The scope of the invention is defined by the claims, which are incorporated into this section by reference. A more complete understanding of the disclosure will be afforded to those skilled in the art, as well as a realization of additional advantages thereof, by a consideration of the following detailed description of one or more implementations. Reference will be made to the appended sheets of drawings that will first be described briefly.

BRIEF DESCRIPTION OF THE DRAWINGS

Examples of the disclosure and their advantages are best understood by referring to the detailed description that follows. It should be appreciated that like reference numerals are used to identify like elements illustrated in one or more of the figures.

DETAILED DESCRIPTION

Figure 1:
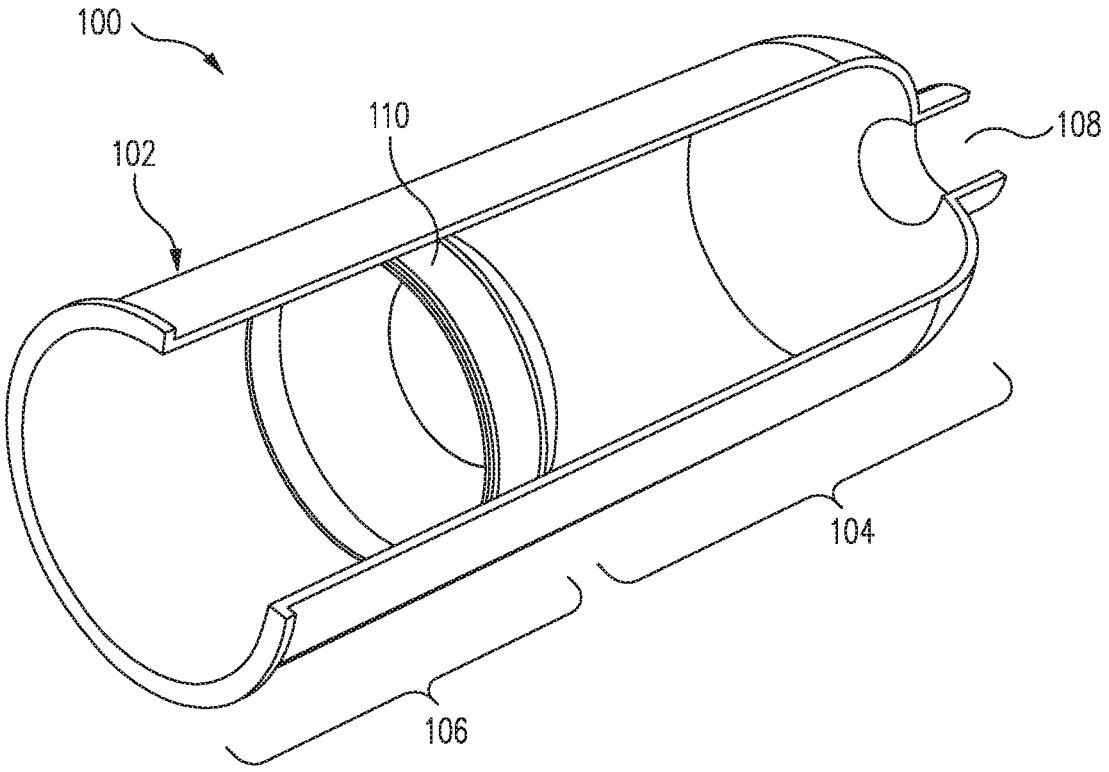
PRIOR ART FIG. 1
FIG. 1 illustrates a partial cutaway view of a prior art container in accordance with examples of the disclosure.

Various examples of systems and techniques for handling materials are described herein. The handling of materials may include storing, transporting, heating, cooling, and/or dispensing the materials. A system can include a container with a body. Such a container body may form and/or may be referred to as a housing, a housing wall, an enclosure, or a shell of the container. The body can include a cavity and a dispensing nozzle. In some aspects, the container body has an inner surface and an outer surface opposite the inner surface. The inner surface may define the cavity and/or the dispensing nozzle. The body can further include one or more channels separate from the cavity. In this regard, the body has walls that separate/compartmentalize the body to define and divide the cavity and each channel. In an aspect, the channel(s) of the body may be disposed adjacent to the cavity and within a portion of the body that separates the channel(s) and the cavity. In some cases, the channel(s) may be considered to be adjacent to the cavity since a single wall/divider separates the channel(s) from the cavity. The channel(s) may receive a fluid. The system can also include a plunger disposed within the cavity.

The materials described herein can be processing materials and other viscous or liquid materials. Such materials can include adhesives, sealants, catalysts, and other such materials used during manufacturing. Certain such materials can have extended shelf lives or processing times if they are transported in certain temperature states such as in an ambient or heated state. In one example, the material may be in a premixed cartridge containing a sealant or an adhesive.

Additionally, many adhesives, sealants, or other materials are two component systems that can cure at room temperature within a few hours, but when stored at low temperatures (e.g., below 0 degrees Celsius) can have a shelf life of months or years. However, storing the material at such temperatures requires the material to be warmed up (e.g., thawed) to a dispensing temperature (e.g., around room temperature) before the material can be extruded and used.

Using various embodiments, channels provided as part of a container may increase a heat transfer rate (e.g., cooling rate or heating rate dependent on application) associated with the material within the container relative to a case in which no channels are utilized. In this regard, the channel(s) may effectively increase a surface area over which heat can transfer to/from the material to volume ratio associated with the container (e.g., relative to containers without channels) to allow faster heat transfer (e.g., thawing) associated with materials within the container.

In some aspects, a fluid or a solid material may be provided in a channel(s) to further accelerate the heat transfer. As an example, a coolant may be pumped through the channel(s) of the container to reduce an amount of time needed to thaw the material within the cavity of the container (e.g., relative to cases in which no coolant is provided). As another example, the solid material may have a shape that is appropriate to fit in a channel and may have an appropriate thermal conductivity to facilitate heat transfer between the material within the container and the solid material. For instance, the channel may define a hollow cylindrical cavity and the solid material may be rod-shaped. In either example, the channel(s) may be disposed adjacent to (e.g., in proximity to) the cavity and within a portion of the container body separating the channel(s) and the cavity to facilitate heat transfer through the portion of the container body between the material within the cavity and the material within the channel(s) (e.g., coolant, solid rod-shaped material, etc.). Such an orientation between the channel(s) and the cavity within the container body provides surface area over which heat can transfer to/from materials within the container.

In some cases, alternative to or in addition to the channel(s), a heating element (e.g., a heat sink element) may be disposed on the container body to allow heat transfer between the material within the container and the heating element. The heating element may include at least one fin and in examples, a plurality of fins. The heating element may include, for example, hair-like structures or protrusions of a variety of shapes such as, for example, rectangular, square, triangular, oval, tubular, and other shapes.

Various example containers described herein can be made from any appropriate material. By way of non-limiting examples, the containers described herein can be made from metals (e.g., aluminum, titanium, steel, or other like metals, or alloys thereof, or mixtures thereof), composites, plastics, or other such materials, or mixtures thereof. The containers described herein can also be fabricated with any combination of appropriate techniques such as extrusion, welding, casting, fastening, bonding, molding, or other such techniques. Furthermore, while the examples of the containers described herein are cylindrical containers, the containers can be of any appropriate shape. As examples, the container can be other shapes such as rectangular, triangular, octagonal, circular, polygonal, and other such shapes.

FIG. 1 illustrates a partial cutaway view of a prior art container in accordance with examples of the disclosure. FIG. 1 illustrates a container 100 that includes a container body 102 with a cavity. A plunger 110 is disposed within the cavity and divides the cavity into a cavity front section 104 configured to receive and store a material and a cavity back section 106. The plunger 110 is movable within the cavity. The plunger 110 may have a curved or straight shape. The plunger 110 may be flush with an inner surface of the cavity of the container body 102. The material stored within the cavity front section 104 can be dispensed through a nozzle 108 located on a first end of the container body 102 by pressing the plunger 110 toward the nozzle 108. In certain examples, a cap can be disposed on the nozzle 108 until dispensing of the material is desired.

The container body 102 has a lower surface area to volume ratio than container bodies in accordance with various embodiments. Such a low ratio associated with the container body 102 limits heat transfer between an environment and the container 100 and, thus, between the environment and the material stored within the container 100. Accordingly, a greater amount of time is required to cool and/or heat the container 100 to bring the material stored within to an appropriate temperature. For instance, in aircraft assembly and fabrication, the material (e.g., sealant, adhesive, etc.) may need to be thawed before application. Thawing of the material within the container 100 can require a long period of time and thus decrease production throughput.

The systems and techniques of the disclosure can decrease the amount of time required to cool or heat materials contained within the containers described herein. In various embodiments, such a decrease in the amount of time may be due at least in part to utilization of a container body having a higher surface area to volume ratio.

Figure 2:
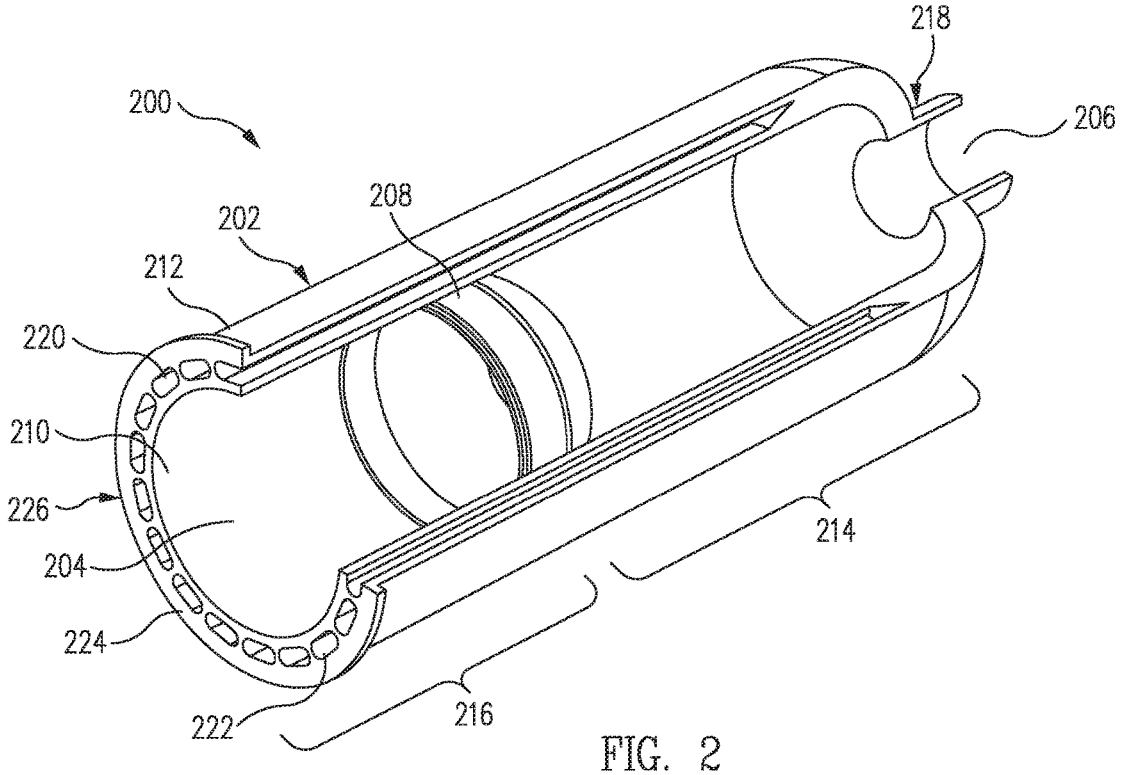
FIG. 2 illustrates a partial cutaway view of a container in accordance with an example of the disclosure.
Figure 3:
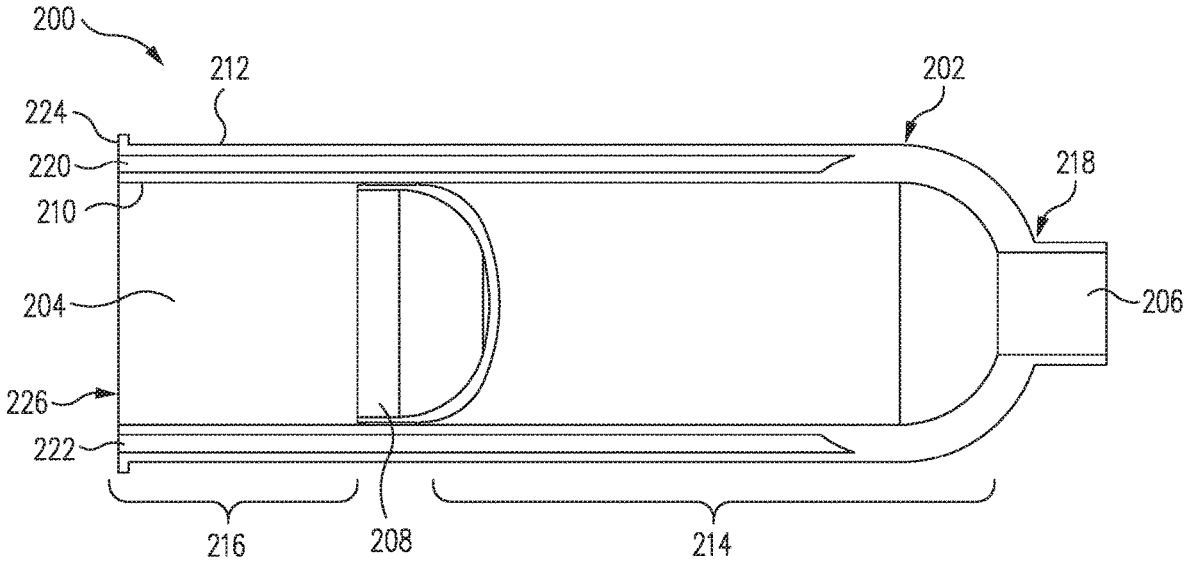
FIG. 3 illustrates a side cutaway view of the container of FIG. 2 in accordance with an example of the disclosure.

FIGS. 2 and 3 illustrate a partial cutaway view and a side cutaway view, respectively, of a container 200 in accordance with an example of the disclosure. The container 200 includes a container body 202. The container body 202 includes a cavity 204, a nozzle 206, and a plunger 208. The cavity 204, the nozzle 206, and the plunger 208 are disposed within the container body 202. The container body 202 has an inner surface 210 and an outer surface 212 opposite the inner surface 210. The inner surface 210 and the outer surface 212 collectively define a nominally annular cross-section of the container body 202. The inner surface 210 may define the cavity 204 and the nozzle 206 of the container 200. In an aspect, the container body 202 is formed integrally (e.g., formed in a single piece).

The plunger 208 is disposed within the cavity 204 and divides the cavity 204 into a cavity front section 214 configured to receive and store a material and a cavity back section 216. The plunger 208 may be in contact (e.g., direct physical contact) with the inner surface 210 of the container body 202. The material stored within the cavity front section 214 can be dispensed through the nozzle 206 located on (e.g., defined at) a first end 218 of the container body 202 by pressing the plunger 208 toward the nozzle 206.

The container body 202 also includes a plurality of channels (e.g., of which channels 220 and 222 are explicitly labeled in FIG. 2) separate from the cavity 204 and disposed within the container body 202. In this regard, the container body 202 includes separate compartments (e.g., separated by walls of the container body 202) that define and divide the channels (e.g., including the channels 220 and 222) from the cavity 204 such that the channels are separate from the cavity 204. The channels are disposed on (e.g., form openings on) a surface 224 of the container body 202 and extend parallel to and between the inner surface 210 and the outer surface 212. In FIGS. 2 and 3, the channels are disposed outward (e.g., distributed radially outward) of and surround the cavity 204. Such channels may be referred to as annular channels and may be of any shape such as circular, rectangular, square, triangular, a polygon having from about 5 to about 8 sides, and other shapes. There can be from about 5 to about 100, or from about 10 to about 50, or from about 15 to about 20 channels spaced on the surface 224. The channels can abut each other or can be spaced evenly or sporadically apart around the surface 224. There can be more than one row of channels.

In an aspect, the plurality of channels are each configured to receive a fluid, such as a liquid (e.g., heated or cooled coolant) or a gas (e.g., ambient air). In certain examples, the fluid can be pumped through the channels. In other examples, the fluid flow into the channels without being forced. For instance, ambient air can flow into the channels or the container body 202 can be placed in a bath and a liquid can naturally flow into the channels. Since the channels surround the cavity 204, the fluid facilitates heat transfer between the material in the cavity 204 and the fluid in the channels. Each of the channels is disposed adjacent to the cavity 204 and within a portion of the container body 202 separating the channels and the cavity 204. The channels are separated from the cavity 204 by a wall of the container body 202 having the inner surface 210 and the outer surface 212 and can thus be considered adjacent to the cavity 204. The channels allow heat to be transferred through the portion (e.g., walls) of the container body 202 to effectuate heat transfer between the fluid in the channels and the material in the cavity 204. As such, the channels provide a higher surface area over which heat can be transferred to cool or heat (e.g., according to a desired application) the material in the cavity 204. In this regard, relative to a case without such channels, the plurality of channels disposed in the container body 202 increase the surface area to volume ratio of the container body 202. By increasing the surface area to volume ratio of the container body 202, the plurality of channels can increase the rate at which the container body 202 and, thus, the material contained within the cavity front section 214, can be heated or cooled.

Using various embodiments, a fluid may be provided into some or all of the channels disposed in the container body 202 to facilitate heating or cooling of the material contained within the cavity front section 214 of the container 200. In some aspects, a fluid may be selectively provided (e.g., provided or not provided) to each of the channels. By allowing a fluid to be selectively provided to the channels, an amount of fluid can be conserved and/or a heat transfer rate can be controlled. For instance, relative to providing a fluid into all the channels, providing the fluid into less than the full set of channels disposed on the container body 202 may conserve the amount of fluid provided to heat or cool the material and decrease the heat transfer rate.

FIGS. 2 and 3 provide an example in which the channels (e.g., including the channels 220 and 222) include only one opening at a second end 226 of the container body 202 (e.g., no opening at the first end 218). Another example container body can include channels having openings on both first and second ends of the container body. In some cases, including openings on both ends of a given channel of the container body can allow fluid to be easily pumped and flowed through the channel. For instance, in cases where heating of a material in the container body is desired, the pumping of the fluid can allow the container body to function as a heat exchanger and increase heat transfer between the material and the fluid that is flowed through the channel. In some cases, rather than a plurality of channels disposed between and extending through the inner surface 210 and the outer surface 212, a container body may include a single circular channel disposed between and extending through the inner surface 210 and the outer surface 212.

Figure 4:
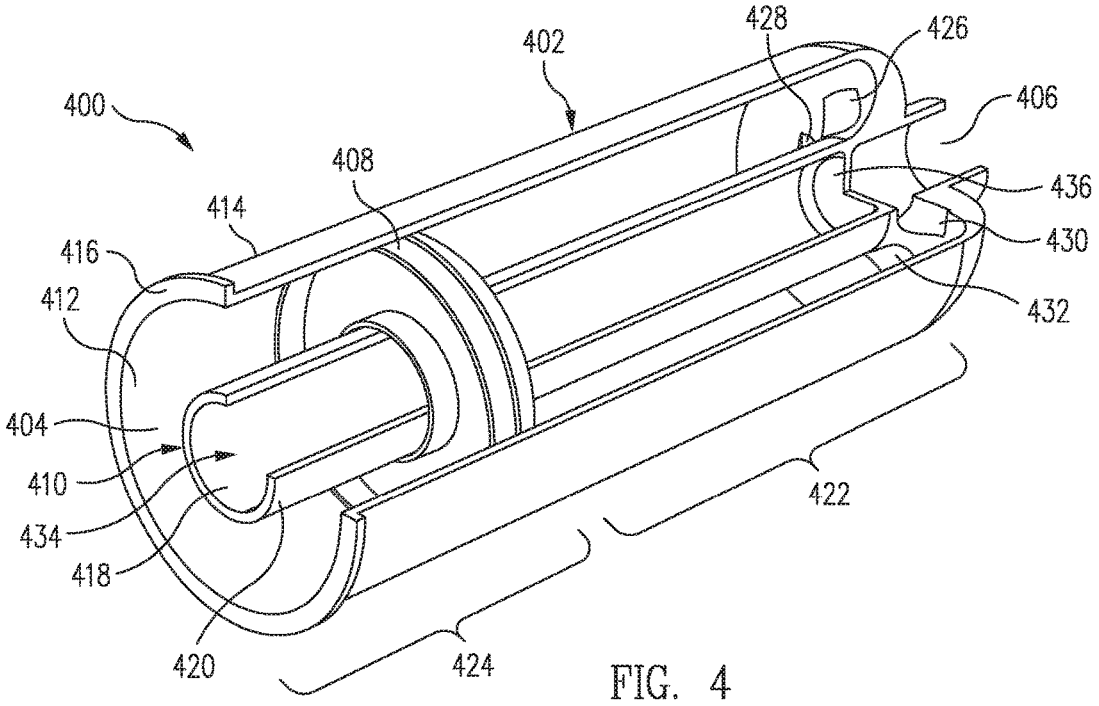
FIG. 4 illustrates a partial cutaway view of another container in accordance with an example of the disclosure.
Figure 5:
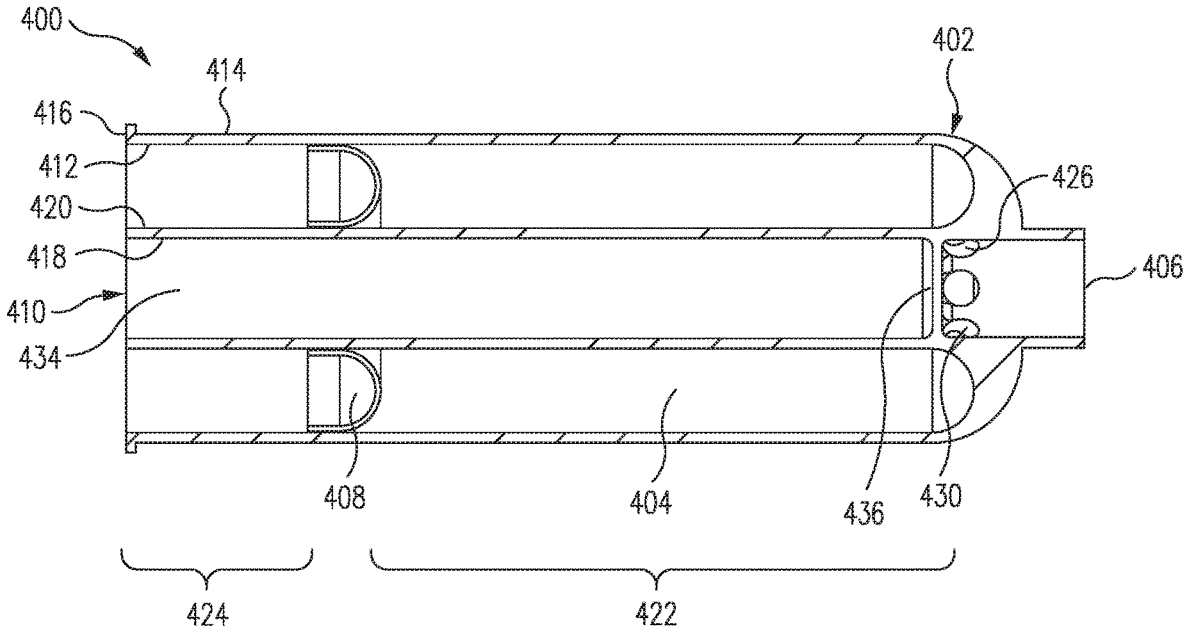
FIG. 5 illustrate a side cutaway view of the container of FIG. 4 in accordance with an example of the disclosure.

FIGS. 4 and 5 illustrate a partial cutaway view and a side cutaway view of a container 400 in accordance with an example of the disclosure. The container 400 includes a container body 402. The container body 402 includes a cavity 404, a nozzle 406, a plunger 408, and a channel 410. The cavity 404, the nozzle 406, the plunger 408, and the channel 410 are disposed within the container body 402. The container body 402 has an inner surface 412, an outer surface 414 opposite the inner surface 412, and a front surface 416. The inner surface 412 defines the cavity 404 of the container 400. The channel 410 is disposed adjacent to the cavity 404 within a portion of the container body 402 that separates the cavity 404 from the channel 410. In this regard, the channel 410 is disposed inward of the cavity 404. The channel 410 is separated from the cavity 404 by a wall of the container body 402 having the inner surface 418 and the outer surface 420 and the channel 410 can thus be considered adjacent to the cavity 404. In FIGS. 4 and 5, the channel 410 is disposed within a center section of the container body 402. The channel 410 has an inner surface 418, an outer surface 420 opposite the inner surface 418, and a wall 436. The inner surface 418 of the channel 410 defines a cavity 434 of the channel 410. The outer surface 420 of the channel 410 faces the inner surface 412 of the container body 402. Although various surfaces of the container body 402 are depicted as being nominally concentric in FIGS. 4 and 5, the various portions need not be nominally concentric.

The plunger 408 is disposed within the cavity 404 and divides the cavity 404 into a cavity front section 422 and a cavity back section 424. In FIGS. 4 and 5, the cavity front section 422 and the cavity back section 424 are provided in an outer section of the container 400. The cavity front section 422 and the cavity back section 424 each have a hollow cylindrical shape. The plunger 408 has a circular shape appropriate to contact the inner surface 412 of the container body 402 and the outer surface 420 of the channel 410. The plunger 408 has an opening in the center to allow for the placement of the channel 410. As the plunger 408 moves along the inside of the cavity 404, it surrounds and contacts the channel 410. The plunger 408 may have a curved surface or a flat surface as in FIGS. 2 and 3. The plunger 408 can extrude out a material disposed within the cavity front section 422 through the nozzle 406 via openings (e.g., including openings 426, 428, 430, and 432) defined in the container body 402. In this regard, the material may be disposed in a portion of the cavity front section 422 that is between the inner surface 412 of the container body 402 and the outer surface 420 of the channel 410.

In some aspects, the channel 410 can be similar to the channels of FIGS. 2 and 3 (e.g., including the channels 222 and 224) in that the channel 410 is configured to receive a fluid to improve the rate of heating or cooling of the container 400 and, thus, the material contained within the container 400. In this regard, fluid can be pumped through the channel 410. In some cases, alternatively or in addition, the channel 410 may be utilized to receive a solid material of high thermal conductivity material to allow heat transfer between the rod and the material contained within the cavity front section 422. The solid material may be rod-shaped to fit in the channel 410. The solid material may contact the inner surface 418 of the channel 410. The wall 436 may block the fluid or the rod from reaching the nozzle 406.

The cavity front section 422 is fluidically connected (e.g., a fluid can flow therebetween) to the nozzle 406 through the openings (e.g., including the openings 426, 428, 430, and 432). As the cavity front section 422 is disposed around the channel 410, the openings allow the material to flow from the outer section of the container body 402 to the nozzle 406 that is disposed within the central section of the container body 402. In other cases, the channel 410 may be offset from the central section and/or from the nozzle 406.

Since the channel 410 is disposed within the center section of container body 402, the channel 410 increases the amount of surface area of the cavity front section 422 relative to a case in which the channel 410 is not provided and an entire volume confined within the inner surface 412 is filled with the material. As such, the surface area of the portion of the material that is disposed adjacent to a surface open to an external environment is thus increased. A fluid (e.g., coolant and ambient air) can contact the inner surface 418 of the channel 410 and the outer surface 414, thus increasing the rate of heat transfer to the material.

In an aspect, disposing of the channel 410 in the middle of the container 400 increases heat transfer to the cavity front section 422 that surrounds the channel 410. The channel 410 is separated from the nozzle 406 to prevent any fluids within the channel 410 (e.g., after heating up the material) from contaminating the dispensed material. In this regard, the inner surface 418, the outer surface 420, and the wall 436 of the channel 410 may help prevent material in the channel 410 from entering the cavity 404 and, similarly, help prevent material in the cavity 404 from entering the channel 410. While the channel 410 of FIGS. 4 and 5 includes a single opening, another example channel can include openings on both ends to allow fluid to flow within the channel. In such an example, the opening on a first end (e.g., nozzle end) of the container body for the channel can be outside of the nozzle.

While the container body 402 is an example with one channel disposed within the cavity 404 of the container body 402, other examples can include a plurality of channels disposed within the cavity 404. Having a plurality of channels can further increase the surface area to volume ratio, further increasing heat transfer associated with the material within the container 400. In certain examples, the channels of FIG. 2 and the channel 410 can be combined within a single container body (e.g., to further facilitate heat transfer).

In an aspect, the container body 402 is formed integrally (e.g., formed in a single piece), in which various structures of the container body 402 are used to form walls, openings, and so forth to define various components (e.g., the cavity 404, the nozzle 406, the channel 410, the openings 426, 428, 430, and 432, and so forth) shown in FIGS. 4 and 5. It is noted that the inner surface 418 and the outer surface 420 may be considered inner surfaces of the container body 402.

Figure 6:
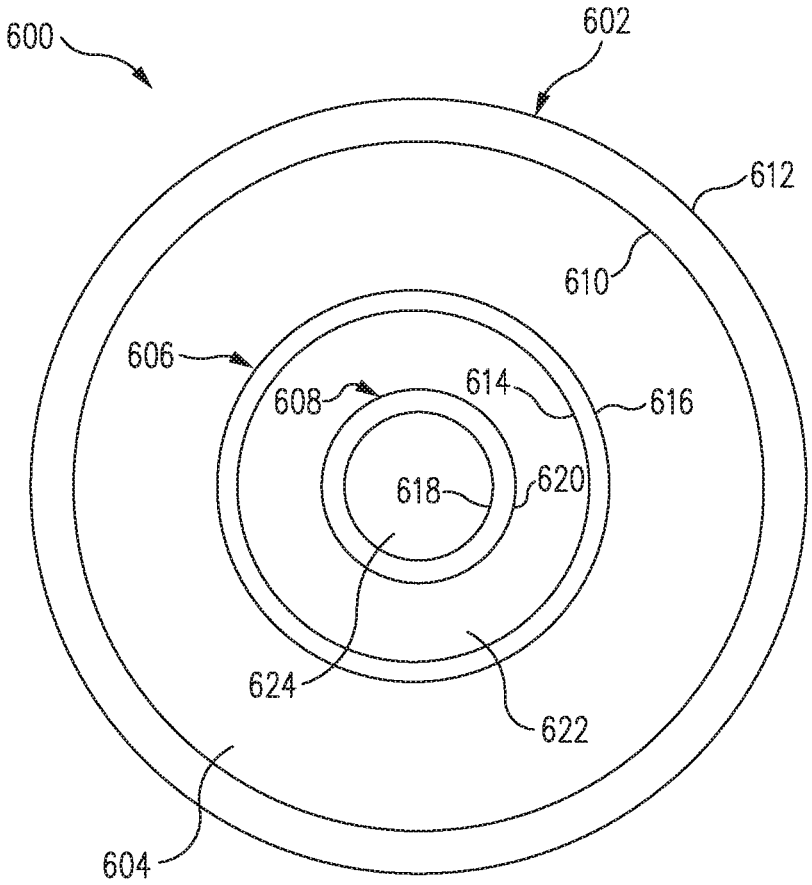
FIG. 6 illustrates a rear cutaway view of another container in accordance with an example of the disclosure.

FIG. 6 illustrates a rear cutaway view of a container 600 in accordance with an example of the disclosure. The container 600 includes a container body 602. The container body 602 includes a cavity 604, a channel 606, and a channel 608. The container body 602 includes an inner surface 610 and an outer surface 612 opposite the inner surface 610. The inner surface 610 defines the cavity 604. The channel 606 includes an inner surface 614 and an outer surface 616 opposite the inner surface 614. The channel 606 includes an inner surface 618 and an outer surface 620 opposite the inner surface 618. The inner surface 610 of the container body 602 faces the outer surface 616 of the channel 606. The inner surface 614 of the channel 606 faces the outer surface 620 of the channel 608. The inner surface 610 of the container body 602 and the outer surface 616 of the channel 606 define the cavity 604. The inner surface 614 of the channel 606 and the outer surface 620 of the channel 606 defines a cavity 622. The inner surface 618 of the channel 608 defines a cavity 624. The cavity 604 can be considered to be adjacent to the cavity 622, and the cavity 622 can be considered to be adjacent to the cavity 624.

The cavities 604 and 624 are each configured to receive a material to be dispensed (e.g., through a nozzle of the container 600). In certain examples, the cavities 604 and 624 are fluidically connected. The cavity 622 is configured to receive a fluid. The fluid may be provided to (e.g., pumped into) the channel 606 or may be received by the channel 606 through exposure to an outside environment (e.g., ambient air). The channel 606 is disposed within the container body 602 such that the cavity 622 is between the cavities 604 and 624. Thus, the channel 606 is configured to expose a surface area of portions of the material in both the cavities 604 and 624 to the fluid in the channel 606 for heat transfer (e.g., to heat or cool the material in the cavities 604 and 624). Disposing the cavity 622 between the cavities 604 and 624 provides a large surface area over which to allow heat transfer between the material in the cavities 604 and 624. The cavity 622 may be defined with appropriate walls and surfaces to prevent material in the cavity 622 from entering the cavities 604 and 624, and to prevent material in the cavities 604 and 624 from entering the cavity 622.

In an aspect, the container body 602 is formed integrally (e.g., formed in a single piece), in which various structures of the container body 602 are used to form walls, openings, and so forth to define various components (e.g., the cavities 604, 622, and 624) shown in FIG. 6. In such an aspect, it is noted that the inner surfaces 614 and 618 and the outer surfaces 616 and 620 may be considered inner surfaces of the container body 602. Although various portions of the container body 602 are depicted as being nominally concentric in FIG. 6, in other embodiments, the various portions need not be concentric.

Figure 7:
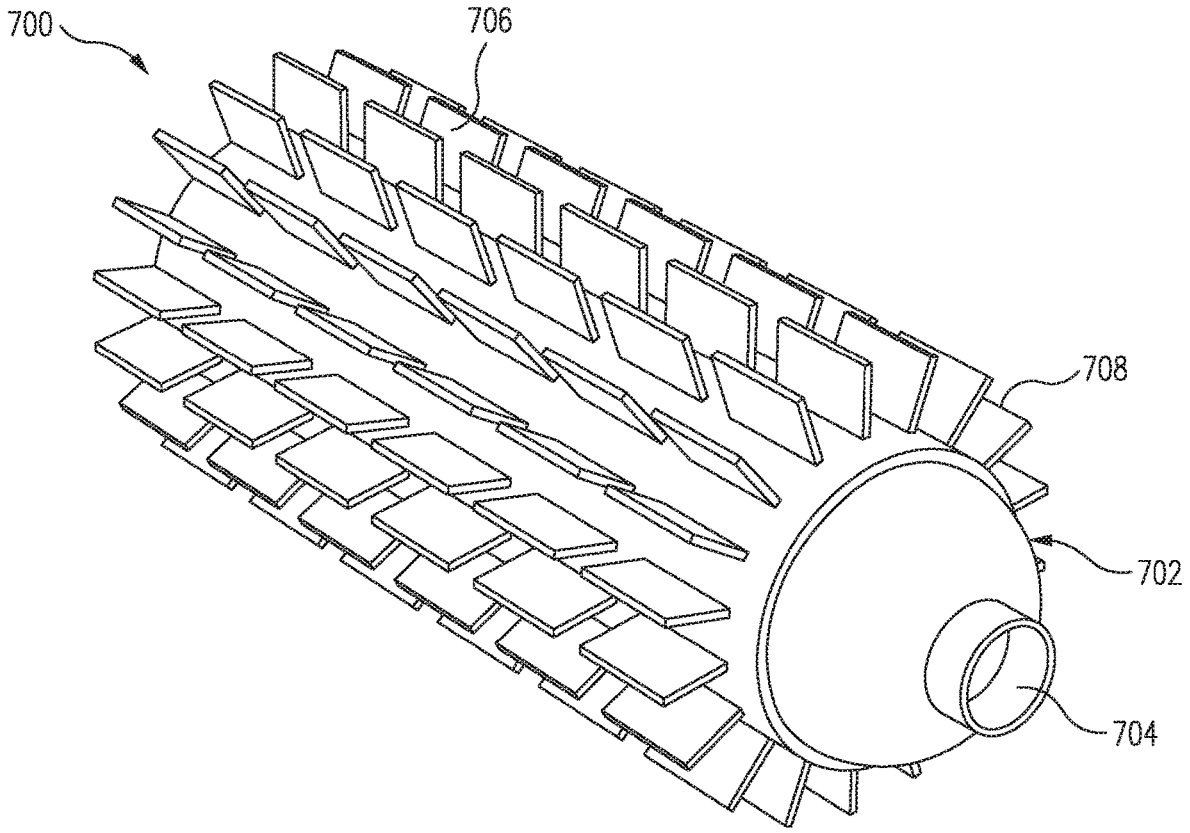
FIG. 7 illustrates a perspective view of another container in accordance with an example of the disclosure.

FIG. 7 illustrates a perspective view of a container 700 in accordance with an example of the disclosure. The container 700 includes a container body 702 with a nozzle 704 and heat sink elements (e.g., of which heat sink elements 706 and 708 are labeled in FIG. 7). A material can be provided in the container body 702 (e.g., a cavity defined within the container body 702) and dispensed using the nozzle 704. A plunger can be disposed within the container body 702 and pressed toward the nozzle 704 to dispense the material.

As shown in FIG. 7, the heat sink elements can be provided adjacent to an outer surface of the container body

702. In certain examples, the heat sink elements are permanently coupled to (e.g., through fasteners, adhesives, and/or welding) or formed as a part of the container body 702. In other examples, the heat sink elements can be removably coupled to the container body 702. The heat sink elements can accordingly be removed after the material has been heated or cooled to a desired temperature. In one such example, the heat sink elements can be provided on a removable sleeve or other item that can cover the outer surface of the container body 702. In another example, the heat sink elements can be inserted into the container body 702 (e.g., similar to that described below with respect to FIG. 9). In some embodiments, the heat sink elements can be provided on any of the container bodies 202, 402, and 602 previously described to facilitate heat transfer with a material disposed in the container bodies 202, 402, and 602.

As shown in FIG. 7, each heat sink element includes a fin. The fins increase the effective surface area of the container body 702, increasing the rate of heat transfer between the container body 702 and the environment. In one example, the heat sink elements may be made of thermally conductive material, such as aluminum, copper, or steel. In some cases, air may be circulated around the fins to facilitate the heat transfer between the fins and the material.

Figure 8:
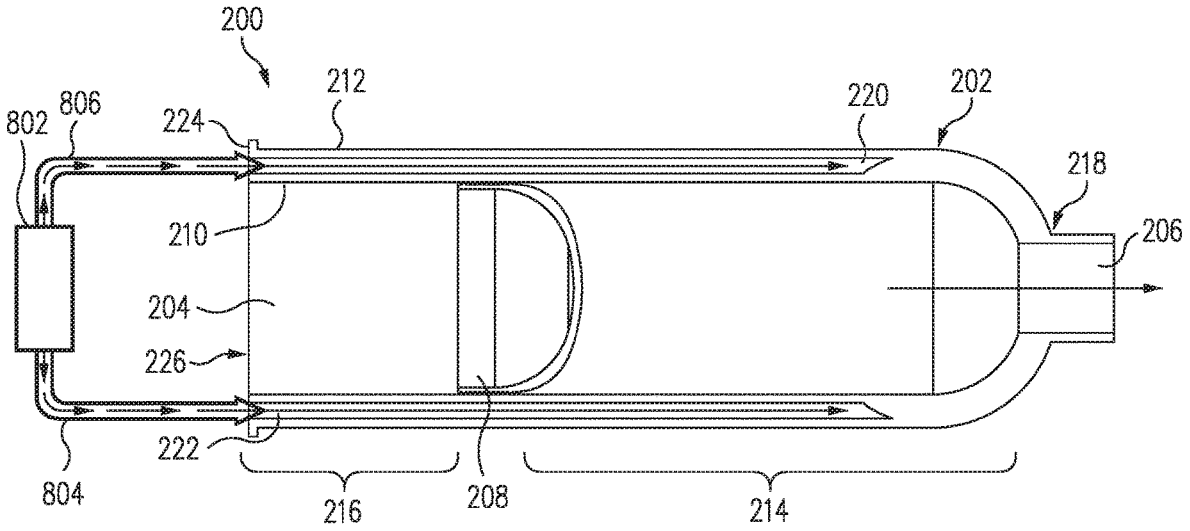
FIG. 8 illustrates an example usage of the container of FIGS. 2 and 3 with a fluid pumping device coupled thereto in accordance with an example of the disclosure.

FIG. 8 illustrates the container 200 of FIGS. 2 and 3 with a fluid pumping device 802 coupled thereto to facilitate cooling or heating of the material within the container 200 in accordance with an example of the disclosure. The fluid pumping device 802 may include one or more pumps and one or more reservoirs for storing a fluid to be pumped into the channels 220 and 222. A hose attachment 804 and a hose attachment 806 is coupled to the channel 220 and the channel 222, respectively, to allow the fluid pumping device 802 to pump the fluid from the reservoir of the fluid pumping device 802 to the channel 220 and the channel 222, respectively. Arrows within the hose attachments 804 and 806 represent a flow of the fluid from the fluid pumping device 802 (e.g., from the reservoir(s) of the fluid pumping device 802) to the channels 220 and 222, respectively. The hose attachments 804 and 806 may be permanently attached or releasably attached to the fluid pumping device 802.

In some cases, once the channels 220 and 222 are pumped with the fluid, the hose attachments 804 and 806 may be detached from the container 200 and a stopper placed on each of the channels 220 and 222 to prevent leakage of the fluid from the channels 220 and 222. In some cases, in order to allow the material within the cavity front section 214 to reach a desired temperature, the hose attachments 804 and 806 may continuously the fluid into the channels 220 and 222 and allow the fluid to circulate out of the channels 220 and 222 to be replenished with additional fluid at an appropriate temperature to cool or heat the material.

The fluid pumping device 802 may also pump the fluid into other channels disposed in the container body 202 of the container 200. Although the fluid pumping device 802 includes two hose attachments, a fluid pumping device may include a single hose attachment or more than two hose attachments. In some cases, a fluid pumping device may simultaneously pump the fluid into multiple channels of the container. In some cases, a number of channels may exceed a number of hose attachments that can be attached to the fluid pumping device 802 at any given time. In such cases, the fluid pumping device may be coupled to a first set of channels to pump the fluid into the first set of channels. The fluid pumping device 802 may then be detached from the first set of channels, may be coupled to a second set of channels, may pump the fluid into the second set of channels, and so forth. Furthermore, although the fluid pumping device 802 is described with reference to the container 200 of FIGS. 2 and 3, the fluid pumping device 802 may be utilized to pump a fluid into the channel 410 of FIGS. 4 and 5.

Figure 9:
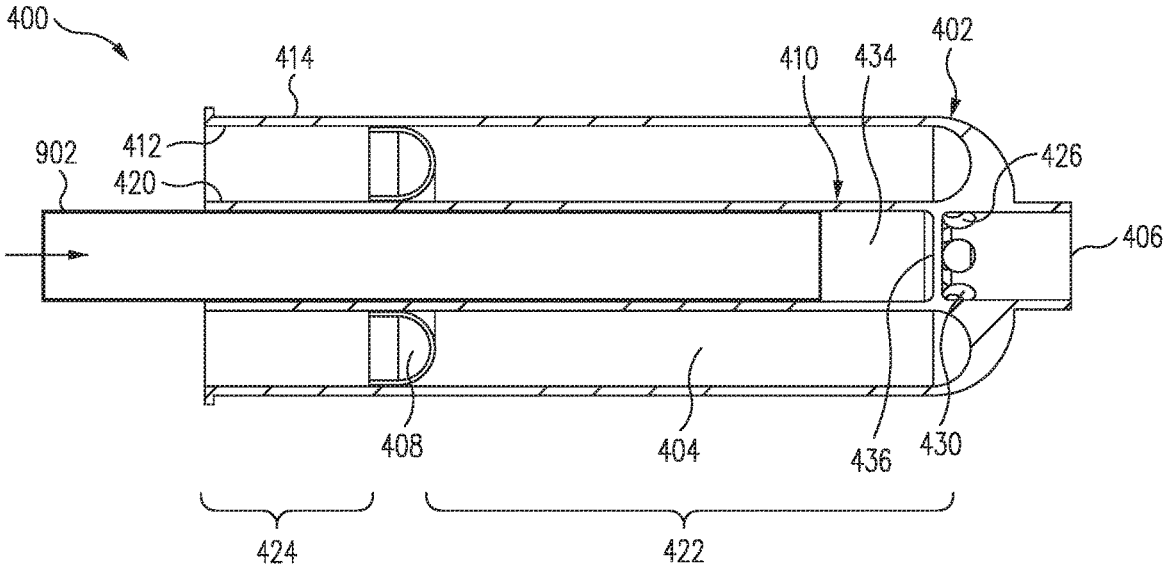
FIG. 9 illustrates an example usage of the container of FIGS. 4 and 5 with a solid material inserted therein in accordance with an example of the disclosure.

FIG. 9 illustrates the container 400 of FIGS. 4 and 5 with a solid material 902 inserted therein to facilitate cooling or heating of the material within the container 400 in accordance with an example of the disclosure. The solid material 902 may be of a high thermal conductivity material to facilitate heat transfer between the solid material 902 and the material contained within the cavity front section 422. In FIG. 9, the solid material 902 is rod-shaped to fit in the channel 410. The solid material 902 may be pushed into the channel 410 (as depicted by an arrow in FIG. 9). In some cases, the solid material 902 may be pushed up against the wall 436. The solid material 902 may be removed once the material within the cavity front section 422 has reached a desired temperature (e.g., a thawed state). In an aspect, the solid material 902 may be utilized as a heat sink.

Figure 10:
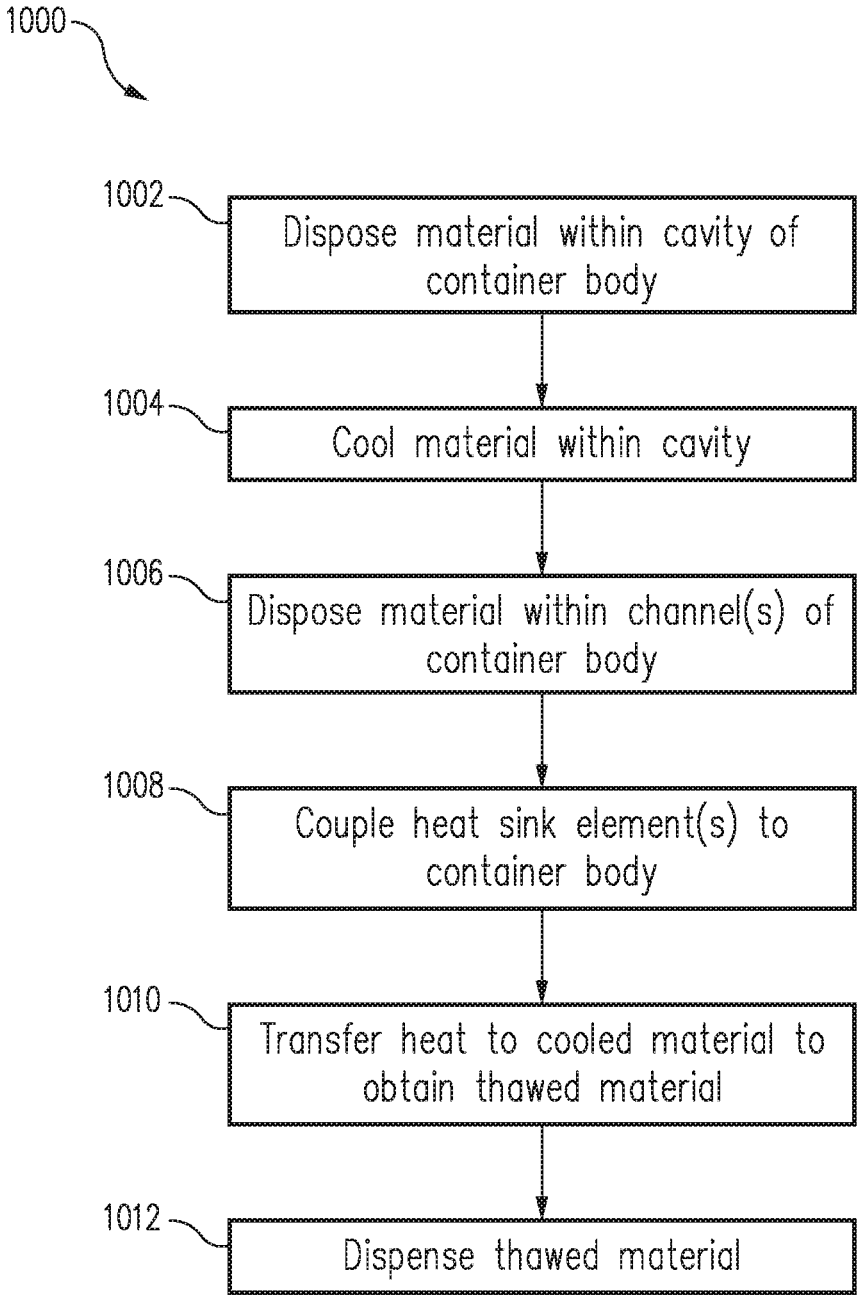
FIG. 10 is a flowchart detailing a technique of using the containers described herein in accordance with an example of the disclosure.

FIG. 10 is a flowchart 1000 detailing a technique of using the containers described herein in accordance with an example of the disclosure. FIG. 10 illustrates a technique of heating or cooling materials stored within a container described herein.

In block 1002, a material is disposed within a cavity of a container body (e.g., the container body 202, 402, 602, or 702) of a container. The material may be pumped, poured, or otherwise dispensed in the cavity of the container body.

In block 1004, the material within the cavity is cooled to obtain cooled material. The material can be cooled by placing the container within a cooled environment (e.g., a freezer or an ice bath). The container can then be stored or transported to another location.

In block 1006, a material is disposed within a channel(s) of the container body to thaw the material in the container. The channel(s) of the container body may be adjacent to the cavity to facilitate heat transfer between the material in the channel(s) and the material in the cavity. In an aspect, the channel(s) is configured to receive a fluid, such as a liquid (e.g., heated or cooled coolant) or a gas (e.g., ambient air). It is noted that, dependent on application, a cooled material may include a material that is frozen or a material that is cooled but not frozen. Further in this regard, thawing may include warming a cooled material, which may be, but need not be, frozen.

In one example, fluid can be pumped through one or more channels (e.g., the channels 220 and 222 of FIGS. 2 and 3, the channel 410 of FIGS. 4 and 5) within the container body. In another example, a rod or other structure having an appropriate thermal conductivity can be provided in one or more channels within the container body. In another example, the container can simply be placed within a fluid (e.g., within a water bath) or exposed to ambient air (either still or forced air driven, for example, by a fan) to allow the fluid or the ambient air to enter the channel(s) to facilitate heat transfer with the material in the cavity.

In block 1008, at least one heat sink element (e.g., the heat sink elements 706 and 708) is coupled to the container body to thaw the material within the cavity. Heat sink elements can be provided on a removable sleeve or other item that can cover an outer surface of the container body. In some aspects, block 1008 is optional, in which case the material within the cavity is thawed primarily based on fluid or gas in the channel(s).

In block 1010, heat is transferred between the cooled material in the cavity and the material in the channel(s) to thaw the cooled material to obtain thawed material. The heat may be transferred between the cooled material and the material disposed within the channel(s). In some cases, when block 1008 is performed, the heat may also be transferred between the cooled material and the heat sink element(s) coupled to the container body. Once the material in the cavity is thawed, the material can be dispensed in block 1012. A plunger of the container can force the thawed material out through a nozzle of the container that is fluidically connected to the cavity.

As such, in various embodiments, the technique of FIG. 10 may be utilized to decrease a thawing time of a cooled fluid material that is disposed in a container body. While FIG. 10 illustrates an example where the material is cooled and then thawed, other examples can utilize similar systems and techniques to heat and then cool a material.

It is noted that sizes and shapes of various components and distances between these components as provided above are examples and that sizes, shapes, and distances may be utilized in accordance with one or more implementations. In addition, the shapes provided herein are nominal shapes. In this regard, as would be appreciated by a person skilled in the art, each shape has an associated tolerance. For instance, containers as manufactured may have a substantially circular cross-section rather than the completely circular cross-section shown in various figures.

Furthermore, while the examples of the containers described herein are cylindrical containers, the containers can be of any appropriate shape. Thus, the container can be other shapes such as rectangular, triangular, octagonal, circular, polygonal, and other such shapes.

Examples described above illustrate but do not limit the invention. It should also be understood that numerous modifications and variations are possible in accordance with the principles of the present invention. Accordingly, the scope of the invention is defined only by the following claims.

What is claimed is:

1. An apparatus comprising:

a container body comprising:

an outer container body surface;

an inner container body surface opposite the outer container body surface;

a cavity disposed within the container body and configured to receive a first material;

a nozzle fluidically connected to the cavity and configured to dispense the first material from the cavity; and a first channel having an outer channel surface facing the inner container body surface and an inner channel surface opposite the outer channel surface, wherein the first channel is disposed adjacent to the cavity and within a portion of the container body separating the first channel and the cavity, wherein the first channel is configured to receive a second material to facilitate heat transfer through the portion of the container body between the first material and the second material, and wherein the inner container body surface and the outer channel surface define the cavity; and a plunger configured to move within the cavity, wherein the plunger is in contact with the outer channel surface of the first channel and the inner container body surface of the container body.

2. The apparatus of claim 1, wherein the container body further comprises a plurality of additional channels between the inner container body surface and the outer container body surface.

3. The apparatus of claim 1, wherein the container body further comprises an opening to connect the cavity and the nozzle.

4. The apparatus of claim 1, further comprising a heat sink element disposed on the container body.

5. A method of using the apparatus of claim 1, the method comprising:

disposing the first material within the cavity;

cooling the first material to obtain cooled material;

storing and/or transporting the cooled material;

thawing the cooled material to obtain thawed material; and dispensing the thawed material through the nozzle.

6. The method of claim 5, wherein the thawing comprises flowing the second material through the first channel to transfer heat between the second material and the cooled material.

7. The method of claim 5, wherein the second material is a solid material, and wherein the thawing comprises inserting the solid material into the first channel to transfer heat between the solid material and the cooled material.

8. The method of claim 5, wherein the second material is a liquid.

9. The method of claim 5, wherein the thawing comprises placing the container body in a bath.

10. The apparatus of claim 1, wherein the container body further comprises a wall configured to block the second material from reaching the nozzle.

11. A method of decreasing thawing time of a frozen fluid material in a container body, said method comprising:

coupling a heat sink element to the container body to cover an outer surface of the container body, wherein said container body comprises:

a cavity holding said frozen fluid material;

a nozzle fluidically connected to the cavity and configured to dispense a thawed version of said frozen fluid material from the cavity; and a first channel disposed adjacent to the cavity and within a portion of the container body separating the first channel and the cavity, wherein the first channel is configured to receive a second material to facilitate heat transfer between the frozen fluid material and the second material;

thawing the frozen fluid material to obtain thawed material; and dispensing the thawed material through the nozzle.

12. The method of claim 11, wherein the container body further comprises:

an inner surface; and an outer surface opposite the inner surface, wherein the inner surface defines the cavity.

13. The method of claim 11, wherein the container body further comprises a second channel disposed inward of the first channel and holding the frozen fluid material.

14. The method of claim 11, wherein the heat sink element comprises at least one fin, and wherein the heat sink element is removably attached to the container body.

15. The method of claim 11, wherein the thawing comprises flowing the second material through the first channel to transfer heat between the second material and the frozen fluid material, and wherein the container body is a single piece.

16. The method of claim 11, wherein the heat sink element comprises a sleeve.

17. A method comprising:

disposing a first material within a cavity of a container body;

cooling the first material to obtain cooled material;

selectively disposing a second material within one or more of a plurality of channels of the container body, wherein the plurality of channels are between inner and outer surfaces of the container body, wherein each channel is adjacent to the cavity and within a portion of the container body separating the channel and the cavity, and wherein each channel is configured to selectively receive the second material to facilitate heat transfer through the portion of the container body between the first material and the second material;

transferring heat between the cooled material and the second material to thaw the cooled material to obtain thawed material; and dispensing the thawed material through a nozzle of the container body.

18. The method of claim 17, wherein the container body further comprises an opening to connect the cavity to the nozzle.

19. The method of claim 17, wherein the container body further comprises a wall, and wherein the method further comprises blocking, by the wall, the second material from reaching the nozzle.

20. The method of claim 17, wherein the container body is a single piece.

* * * * *